United States Patent [19]

Clark

[11] Patent Number: 4,986,364

[45] Date of Patent: Jan. 22, 1991

[54] DUAL PURPOSE FIRE FIGHTING AND VENTILATION APPARATUS

[76] Inventor: Thomas W. Clark, 1108 S. Oneida Ave., Rhinelander, Wis. 54501

[21] Appl. No.: 445,454

[22] Filed: Dec. 4, 1989

[51] Int. Cl.[5] ..... A62C 3/14

[52] U.S. Cl. ..... 169/48; 98/12.15; 169/54; 169/37

[58] Field of Search ..... 169/24, 43, 44, 45, 169/46, 54, 16, 37; 98/42.15

[56] References Cited

U.S. PATENT DOCUMENTS

| | | | |
|---|---|---|---|
| 1,874,573 | 8/1932 | Moore . | |
| 2,120,563 | 6/1938 | Lamb . | |
| 3,583,637 | 6/1971 | Miscovich | 169/54 |
| 3,754,600 | 8/1973 | Miller | 169/45 |
| 4,043,397 | 8/1977 | Glowienke | 169/46 |
| 4,168,748 | 9/1979 | Batte | 169/46 |
| 4,187,913 | 2/1980 | Wilcox | 169/51 |
| 4,488,603 | 12/1984 | Schmittmann et al. | 169/24 |
| 4,703,808 | 11/1987 | O'Donnell | 169/91 |
| 4,779,801 | 10/1988 | O'Donnell | 239/276 |

*Primary Examiner*—Sherman Basinger
*Assistant Examiner*—Stephen P. Avila
*Attorney, Agent, or Firm*—Andrus, Sceales, Starke & Sawall

[57] ABSTRACT

A dual purpose fire fighting and ventilation apparatus comprising a rigid conduit having an inlet end to be connected to a source of water under pressure and having an outlet end. The conduit is mounted in a generally horizontal position in an opening in a building such as a window or doorway, and a fogging nozzle is connected to the outlet end and is located within the building. Manually operable controls serve to adjust the spray pattern of the nozzle as well as moving the nozzle in a vertical path. In use, the conduit is inserted through the opening in the building and locked to the building with the nozzle facing outwardly through the opening. The spray pattern is adjusted and the nozzle is then elevated to create a spray pattern back through the opening and thus provide an aspirating action to draw smoke and air outwardly through the opening to reduce the upward propagation of combustion.

17 Claims, 1 Drawing Sheet

DUAL PURPOSE FIRE FIGHTING AND VENTILATION APPARATUS

BACKGROUND OF THE INVENTION

A fire will normally advance upwardly within a building causing large volumes of heated air, smoke, and other products of combustion to travel to the upper areas of the building with the result that victims can be trapped in the upper floors of a building by the intense heat and gases.

During a fire fighting operation, it is often necessary to send a fire fighter to the roof to vent the roof. This can be a dangerous operation due to the possible collapse of the roof by virtue of the upward travel of the combustion pattern.

It has been recognized that there is a need for controlling the direction of travel of the combustion in a burning building. For example, U.S. Pat. Nos. 4,703,808 and 4,779,801 are directed to smoke eliminator devices which act to create a draft and draw smoke outwardly through a window in the building. In accordance with the aforementioned patents, the smoke eliminator includes a rigid tube which is to be connected to a fire hose and the outer end of the hose is provided with a C-shaped contour which terminates in a fogging nozzle. In use, the C-shaped butt section is used to smash a second story window, and the C-shaped butt section is then inserted through the broken window with the nozzle facing outwardly. The flow through the fogging nozzle creates an aspirating action to draw smoke outwardly from the building through the window.

However, devices as shown in the aforementioned patents have serious disadvantages. There is no adjustment of the spray pattern, nor any adjustment of the position of the nozzle relative to the window or opening. Further, as the fogging nozzle is located in a second story window at a substantial distance above the position of the fire fighter, it is difficult to properly adjust the position of the nozzle. As a further disadvantage, the device as described in the aforementioned patents, can only be used as a smoke eliminator and cannot be used to extinguish a blaze. Because of these shortcomings, devices of this type have seen limited use.

SUMMARY OF THE INVENTION

The summary of the invention is directed to a fire fighting apparatus having particular use for ventilating a burning building. In accordance with the invention, the apparatus includes a rigid conduit having an inlet end to be connected to a source of water under pressure, such as a fire hose, and having an outlet end. The conduit is mounted in a generally horizontal position in an opening in a building such as a window or doorway, and a fogging nozzle is connected to the outlet end, and is located within the building.

Manually operable controls are located adjacent the inlet end of the conduit, and one of the controls acts to adjust the spray pattern of the nozzle while the second control will act to pivot the nozzle in a vertical plane to thereby control the inclination of the spray pattern.

In use, the conduit is inserted through the opening in the burning building, and is locked in a fixed position with respect to the opening either by clamping the conduit to the window or door frame or clamping the conduit to an auxiliary support. With the nozzle facing backwardly toward the opening, the spray pattern is initially adjusted so that it will be smaller than the opening, and the nozzle elevation is then adjusted to center the spray pattern relative to the opening. The flow of water through the nozzle will discharge the spray outwardly of the building through the opening, thereby creating an aspirating action to draw smoke and other heated gases through the opening to reduce the upward propagation of the combustion.

By ventilating the blaze through an existing opening in the building, it is not necessary to send fire fighters to the roof to vent the building and possibly be injured by a roof collapse.

Once the unit is installed, it will operate without the need for manual supervision.

As the upward advance of the flame is retarded, the use of the device will reduce property damage and allow fire fighters to more easily reach victims in the upper stories of the building. Plus, the environment within the building, is cooler, safer, and has better visibility.

In addition, the apparatus of the invention can also be employed to extinguish a blaze, in which case the nozzle is adjusted in position to be directed at the area of the blaze.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

The drawings illustrate a fire fighting apparatus having particular use for ventilating a burning building. The apparatus includes a rigid conduit 1, preferably made of metal, and the inlet end 2 of conduit 1 is threaded and is adapted to be connected to a source of water under pressure such as a fire hose 3. A control valve 4 is mounted adjacent the inlet end of conduit 1 and serves to control the flow of water through the conduit.

Figure 3:
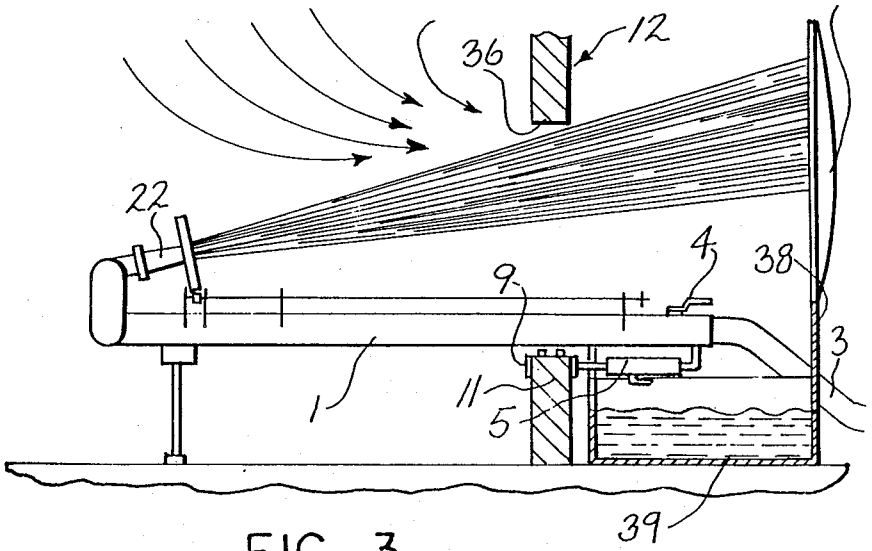
FIG. 3 is a side elevation showing the apparatus in position within a building.

In order to mount the conduit in fixed relation to a building, a hydraulic clamping unit is incorporated with conduit 1. The hydraulic clamping unit includes a cylinder 5 which is connected through bracket 5*a* to conduit 1, and water from hose 3 is supplied to one end of cylinder 5 through a generally L-shaped pipe 6. A piston rod 7, or ram, extends from the opposite end of cylinder 5 and carries a clamping plate 8 which is aligned with a fixed clamping plate 9 connected through bracket 9*a* to conduit 1. Flow of water through the pipe 6 is controlled by a valve 10, and by introducing water through pipe 6 to cylinder 5, piston rod 7 will be extended to clamp a fixed object between the clamping plates 8 and 9. As shown in FIG. 3, the fixed object can be a windowsill 11 of a building 12. Bracket 9*a* is inclined upwardly in a direction toward the inner end of conduit 1 and not only reinforces the fixed clamping plate 9, but the inclined surface facilitates sliding the entire unit over a windowsill.

A drain cock 5b is connected to cylinder 5 and by opening the drain cock the pressure in cylinder 5 can be relieved after closing valve 10.

The outlet end of conduit 1 is supported from the floor of building 12 by a pair of legs 14, the upper ends of which are connected to a bracket 15 that is connected to collar 16 that surrounds conduit 1. Legs 14 are connected to bracket 15 through a hinge pin 15a and a removable locking pin 15b. By inserting pin 15b through hole 15c in bracket 15 and an aligned hole in the upper end 14a of legs 14, the legs can be maintained in a vertical use position. With pin 15b removed, the legs 14 can be pivoted to a storage position where they are generally parallel to conduit 1. By inserting pin 15b through hold 15d and the aligned hole in end 14a, the legs can be maintained in the storage position.

The discharge end of conduit 1 is bent upwardly as indicated by 17 and extends generally at 90° with respect to the remainder of conduit 1. A pair of generally U-shaped pipes 18 are connected to the upper extremity of end 17, and the upper legs 19 of pipes 18 are disposed in axial alignment and are connected by a T-fitting 20. Packing glands 21 permit the T-fitting 20 to be rotated relative to legs 19 of pipes 18.

A fogging nozzle 22 is connected to the outer end of the stem portion 23 of T-fitting 20.

Figure 1:
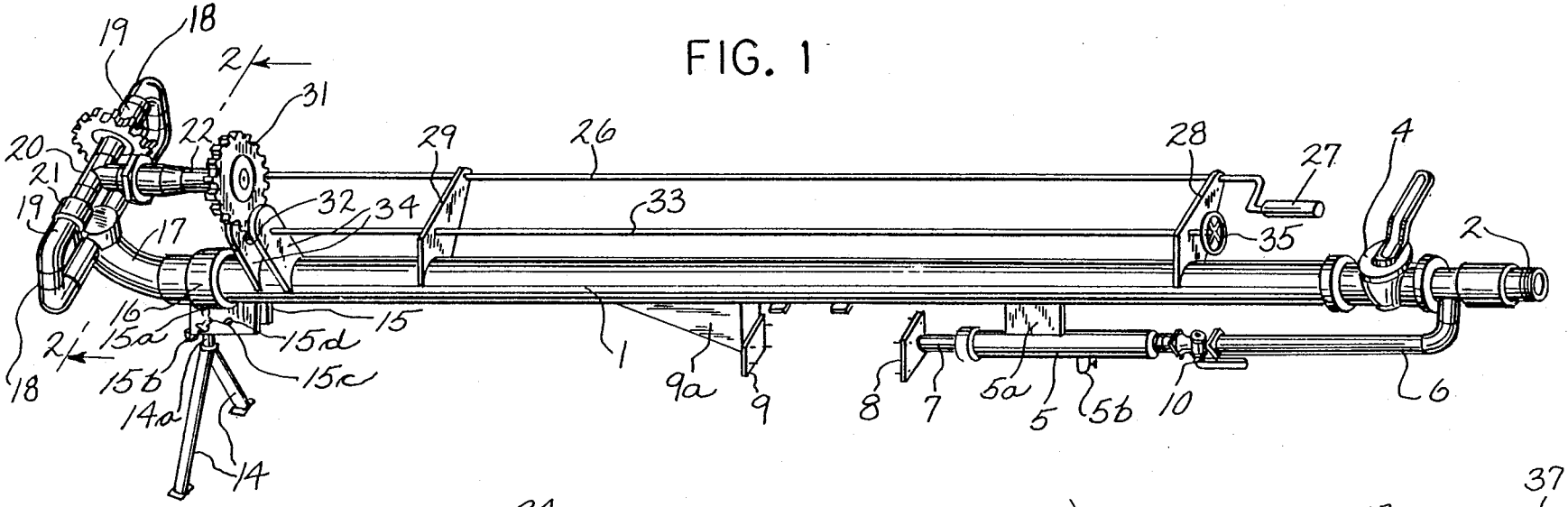
FIG. 1 is a perspective view of the apparatus of the invention.
Figure 2:
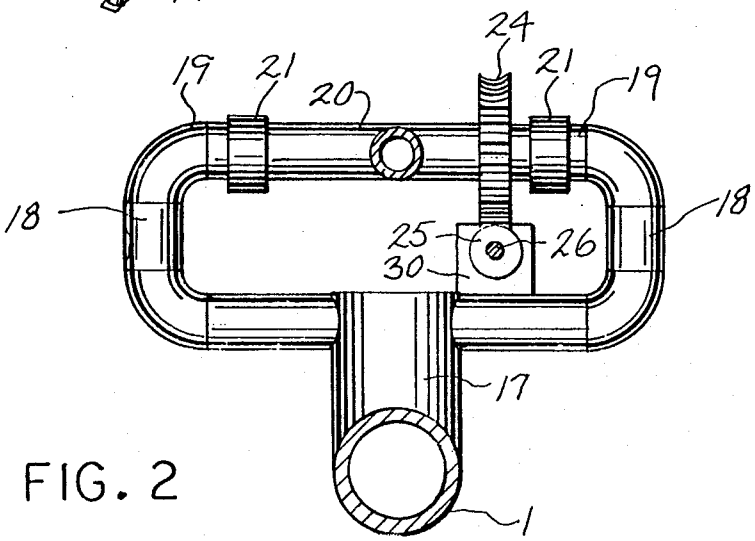
FIG. 2 is a section taken along line 2—2 of FIG. 1.

Nozzle 22 can be rotated in a vertical plane through an arc of about 260°. More specifically, as shown in FIG. 1, the nozzle 22 faces rearwardly toward the inlet end of conduit 1 and can be rotated from this position upwardly to a vertical position, and then downwardly through a horizontal position to a downwardly inclined position.

To pivot nozzle 22 through this arc, a gear 24 is secured to one of the legs 19 of T-fitting 20, and gear 24 is engaged by a worm gear 25 which is mounted on the end of rod 26. The opposite end of rod 26 adjacent the inlet end of conduit 1 carries a handle 27 through which the rod 26 and worm gear 25 can be rotated to thereby rotate gear 24 and T-fitting 20. Rod 26 is journaled for rotation in bushings that are mounted in openings in brackets 28, 29, and 30. Brackets 28 and 29 are secured to conduit 1 while bracket 30 is secured to one of the U-shaped pipes 18. Through this construction, the inclination of the axis of nozzle 22 can be adjusted as desired.

A second adjustment is provided for the spray pattern of nozzle 22. In this regard, a gear 31 is secured to the outer surface of nozzle 22 and meshes with a gear 32 that is mounted on the end of a horizontal control rod 33. Rod 33 is journaled within bushings mounted within openings in plates 34 that extend upwardly from conduit 1 as well as within bushings in the brackets 28 and 29.

The opposite end of rod 30 adjacent the inlet end of conduit 1 carries a wheel 35 and by operation of the wheel, rod 33 will be rotated and this rotation will be transmitted through the gears 31 and 32 to adjust the spray pattern of the nozzle. The nozzle 22 is a standard type and rotation of the outer sleeve of the nozzle will adjust the diameter of the conical spray pattern being emitted from the nozzle.

To use the apparatus as a ventilating device, the nozzle 22 is initially positioned as shown in FIG. 1 where the axis of the nozzle faces rearwardly toward the inlet end of conduit 1. Legs 14 are pivoted to the vertical position and held in that position by insertion of locking pin 15b in the aligned holes in bracket 15 and end 14a. The conduit 1 is inserted through an opening 36, such as a window or a doorway, in building 12 and the inner end of the conduit is supported through legs 14 from the floor of the building, as seen in FIG. 3. By opening valve 10 the clamping cylinder 5 can be operated to bring the clamps 8 and 9 into engagement with the window sill 11, as shown in FIG. 3. In this position, the nozzle is located a substantial distance within the burning building.

The spray pattern of the nozzle is then adjusted through operation of wheel 35 to provide a spray pattern which is smaller in dimension than the window 36 or other opening through which the conduit is inserted. After adjusting the spray pattern, the nozzle 22 is then elevated by rotation of rod 26, moving gear 31 out of engagement with gear 32, until the spray pattern is centered within the window 36.

Water is fed through conduit 1 by opening valve 4, and the water will be discharged from nozzle 22 in the form of a fog spray which will be discharged back through the window 36 or other opening, thereby creating an aspirating effect to draw smoke and other heated gases outwardly through the opening 36. By creating a draft outwardly through opening 36, the upward propagation of the combustion will be reduced.

It is contemplated that the water being discharged from nozzle 22 can be collected for reuse as shown in FIG. 3. This has particular application in rural areas where there is no municipal water system and conservation of water is important. As shown in FIG. 3, a tarpaulin 37 can be mounted on frame 38 outside of the opening or window 36 so that the water being discharged through the opening will strike the tarpaulin and be directed downwardly into a tank 39. A portable pump can then be employed to pump the water in tank 39 back to the engine or other site.

The apparatus of the invention reduces the natural upward burning characteristics of the fire thereby reducing property destruction and creating a cooler, less smoke-filled upper area in the building which will reduce the potential danger to people trapped in the upper floors of the building.

The apparatus will move considerably more air than mechanical devices, such as fans or blowers, and does not require any gasoline engine or electrical hook up. Once the unit is installed, and the spray is properly adjusted, no further manual supervision is required.

The device can also be used as an extinguishing nozzle rather than a ventilating device. In this case, the clamps 8 and 9 are not required, and the conduit 1 is inserted within the opening in the building, and rests on the legs 14. The spray pattern as well as the elevation of the nozzle, can then be adjusted and directed toward the location of the fire.

Various modes of carrying out the invention are contemplated as being within the scope of the following claims particularly pointing out and distinctly claiming the subject matter which is regarded as the invention.

I claim:

1. A dual purpose fire fighting and ventilation apparatus, comprising a rigid conduit having an inlet end to be connected to a source of water under pressure and having an outlet end, a nozzle having a discharge outlet, first mounting means for mounting said nozzle in said outlet end for movement in a generally vertical plane, first adjusting means for moving said nozzle in said plane from a first position where said outlet faces toward said inlet end to a second position where said outlet faces away from said inlet end first support means for supporting said conduit in a fixed position with respect to an opening in a building and comprising clamping means to engage a portion of the building adjacent said opening, and means activated by water pressure in said conduit for operating said clamping means.

2. The apparatus of claim 1, and including second adjusting means for adjusting the spray pattern of said nozzle.

3. The apparatus of claim 1, wherein said clamping means is constructed and arranged to engage the sill of a window of a building.

4. The apparatus of claim 1, wherein said outlet end has a generally L-shaped configuration including a generally horizontal leg connected to said conduit and a generally vertical leg, said first mounting means interconnecting said vertical leg and said nozzle.

5. The apparatus of claim 4, wherein said first mounting means includes a pair of generally U-shaped pipes, each pipe having a first horizontal section connected to said vertical leg, and each pipe having a second horizontal section, said second sections being axially aligned, said nozzle being rotatably connected to said aligned second sections.

6. The apparatus of claim 2, wherein said first and second adjusting means are located adjacent the inlet end of said conduit.

7. The apparatus of claim 6, wherein said first and second adjusting means are located between said first support means and the inlet end of said conduit.

8. The apparatus of claim 1, and including second support means for supporting the outlet end of said conduit from said building.

9. The apparatus of claim 8, wherein said second support means is located between the outlet end of said conduit and said first support means.

10. A dual purpose fire fighting and ventilation apparatus, comprising a rigid conduit having an inlet end to be connected to a source of water under pressure and having an outlet end, a nozzle having a discharge outlet, mounting means for mounting said nozzle for movement in a generally vertical plane, first adjusting means for moving said nozzle in said plane from a first position where said discharge outlet faces toward said inlet end as a ventilation mode to a second position as a fire fighting mode, second adjusting means for adjusting the spray pattern of said nozzle, said second adjusting means comprising a first gear connected to said nozzle, a second gear rotatably connected to said conduit, and an operating member operably connected to said second gear, operation of said operating member acting to drive said gears to thereby adjust the spray pattern of said nozzle, and support means for supporting said conduit in a fixed position with respect to an opening in a building.

11. The apparatus of claim 10, wherein said first and second adjusting means extend to a location between said support means and said inlet end.

12. The apparatus of claim 10, wherein the outlet end of said conduit is bent upwardly and terminates in a vertical leg, a pair of generally U-shaped pipes, each pipe having a first generally horizontal section connected to said vertical leg and having axially aligned second generally horizontal sections, said nozzle being rotatably mounted to said aligned second sections.

13. The apparatus of claim 10, wherein said gears are constructed and arranged to be disengaged on movement of said nozzle from said first position toward said second position.

14. A dual purpose fire fighting and ventilation apparatus, comprising a rigid conduit having an inlet end to be connected to a source of water under pressure and having an outlet end, a nozzle having a discharge outlet, mounting means for mounting said nozzle for movement relative to the outlet end of said conduit, first adjusting means for moving said nozzle from a first position where said discharge outlet faces toward said inlet end as a ventilation mode to a second position where said discharge outlet faces in a direction away from said inlet end as a fire fighting mode, second adjusting means for adjusting the spray pattern of said nozzle, support means for supporting said conduit in a fixed position with respect to an opening in a building, and means responsive to movement of said nozzle from said first position toward said second position for moving said second adjusting means to an inoperative mode.

15. In combination with a building having an opening providing communication between the interior of the building and the exterior, a conduit extending through said opening and having an inlet end located outside of said building and connected to a source of water under pressure and having an outlet end disposed in the building, a nozzle having a discharge outlet, mounting means for mounting said nozzle for movement relative to the outlet end of said conduit, and adjusting means for moving said nozzle from a first position where said discharge outlet faces toward said inlet end and said water is discharged from said discharge outlet back through said opening to the exterior of said building as a ventilation mode to a second position wherein water is discharged from said discharge outlet to a location within the building as a fire fighting mode.

16. The combination of claim 15, and including support means for supporting said conduit in a fixed position with respect to said opening.

17. The combination of claim 15, and including a tank located outside of the building adjacent said opening, and deflector means disposed outside of said building in alignment with said opening and disposed to deflect water being discharged through said opening during said ventilation mode to said tank.

* * * * *